US009096240B2

(12) United States Patent
Rodet

(10) Patent No.: US 9,096,240 B2
(45) Date of Patent: Aug. 4, 2015

(54) BOGIE FOR RAILWAY VEHICLE WITH A SUSPENSION SYSTEM

(71) Applicant: Alain Rodet, Chalon sur Saone (FR)

(72) Inventor: Alain Rodet, Chalon sur Saone (FR)

(73) Assignee: ALSTOM TRANSPORT TECHNOLOGIES, Levallois-Perret (FR)

( * ) Notice: Subject to any disclaimer, the term of this patent is extended or adjusted under 35 U.S.C. 154(b) by 231 days.

(21) Appl. No.: 13/920,996

(22) Filed: Jun. 18, 2013

(65) Prior Publication Data

US 2013/0333590 A1 Dec. 19, 2013

(30) Foreign Application Priority Data

Jun. 18, 2012 (FR) ..... 12 55669

(51) Int. Cl.

| | |
|---|---|
| ***B61F 5/50*** | (2006.01) |
| ***B61D 13/00*** | (2006.01) |
| ***B61F 3/04*** | (2006.01) |
| ***B61F 5/30*** | (2006.01) |
| ***B61F 5/32*** | (2006.01) |
| ***B61F 5/52*** | (2006.01) |

(52) U.S. Cl.

CPC . *B61F 5/50* (2013.01); *B61D 13/00* (2013.01); *B61F 3/04* (2013.01); *B61F 5/301* (2013.01); *B61F 5/325* (2013.01); *B61F 5/52* (2013.01)

(58) Field of Classification Search

CPC ..... B61F 5/26; B61F 5/30; B61F 5/301; B61F 5/305; B61F 5/307; B61F 5/325; B61F 5/36; B61F 5/50; B61F 5/52; B61F 3/04; B61F 5/24; B61F 3/02; B61F 5/32; B61D 13/00

USPC ..... 105/158.2, 175.1, 218.1, 218.2, 224.05, 105/182.1, 167, 206.1, 135, 139

See application file for complete search history.

(56) References Cited

U.S. PATENT DOCUMENTS

| | | | | |
|---|---|---|---|---|
| 2,286,608 | A * | 6/1942 | Eksergian | 105/182.1 |
| 2,473,714 | A * | 6/1949 | Krotz | 105/182.1 |
| 3,774,550 | A * | 11/1973 | Lich | 105/182.1 |
| 3,946,676 | A * | 3/1976 | Mackaness et al. | 105/169 |
| 5,448,953 | A * | 9/1995 | Bieker et al. | 105/158.2 |
| 8,365,675 | B2 | 2/2013 | Rodet et al. | |
| 8,978,563 | B2 * | 3/2015 | Rodet et al. | 105/133 |

FOREIGN PATENT DOCUMENTS

| | | |
|---|---|---|
| DE | 10 80 583 B | 4/1960 |
| EP | 0 326 179 A1 | 8/1989 |
| FR | 1 394 160 A | 4/1965 |
| FR | 2 914 609 A1 | 10/2008 |
| GB | 2 289 877 A | 12/1995 |

* cited by examiner

*Primary Examiner* — Mark Le

(74) *Attorney, Agent, or Firm* — Davidson, Davidson & Kappel, LLC

(57) ABSTRACT

A bogie is provided. The bogie includes two pairs of wheels, the wheels of each pair are connected to each other by an axle structure, this axle structure includes, for each wheel, an axle box. The bogie includes an articulated chassis, each axle structure is supported by the chassis by way of the primary suspension device. The primary suspension device includes, for each wheel, an arm extending substantially longitudinally between a first end that is integrally joined with the axle box associated with this wheel, and a second free end. The arm is articulated between the first and second ends about a pivot connection with the chassis. For each arm, a primary helical spring extends between a first seat provided on the second end of the arm, and a second seat carried by the chassis.

9 Claims, 2 Drawing Sheets

BOGIE FOR RAILWAY VEHICLE WITH A SUSPENSION SYSTEM

Priority is hereby claimed to FR 12 55669 filed on Jun. 18, 2012, the entire disclosure of which is hereby incorporated by reference herein.

The present invention relates to a bogie for a railway vehicle with sophisticated suspension system, in particular for a low floor tram.

BACKGROUND

It is already known in the prior art, in particular from FR 2 946 307, a railway vehicle bogie comprising two pairs of wheels, the wheels of each pair being connected to each other by an axle structure. The bogie also includes an articulated chassis, supporting the axle structures through the primary suspension means.

It should be noted that a chassis is called "articulated" when it has two parts (or half chassis) that are connected and articulate relative to one another about an axis. Such an articulated chassis makes it possible to limit wheel unloading induced by track defects (also called "track twists"). Thus, the articulated chassis enables the bogie to overcome the track twists, that is to say, it may have ground control points that are not in the same running plane.

When the bogie is designed to equip a low floor railway vehicle, the vertical space requirement of the suspensions should be relatively reduced. To this end, the suspensions are generally formed by resilient bodies made of elastomeric material, in particular rubber, which are compact and space saving.

However, such elastomeric members lose effectiveness over time. In addition, the effectiveness of these elastomeric members is also reduced when their temperature is very high or very low, which can occur when the train is travelling through a country having hot or cold weather.

BRIEF SUMMARY OF THE INVENTION

An object of the present invention may overcome this drawback by providing a railway vehicle bogie the suspension systems of which remain effective no matter what their temperature, and wherein the suspension systems have a satisfactory service life, all while offering a reduced vertical space requirement in order for the bogie to be fitted to a low floor railway vehicle.

The present invention provides a bogie for a railway vehicle, in particular a low-floor tram, including the following:

two pairs of wheels, the wheels of each pair being connected to each other by an axle structure, this axle structure including, for each wheel of the corresponding pair, an axle box, and an articulated chassis, each axle structure being supported by the chassis by way of the primary suspension means, characterised in that the primary suspension means includes the following:

for each wheel, an arm extending substantially longitudinally between a first end that is integrally joined with the axle box associated with this wheel, and a second free end, the arm being articulated between its first and second ends about a pivot connection with the chassis, and for each arm, a primary helical spring extending between a first seat, provided on the second end of said arm, and a second seat carried by the chassis, and wherein the chassis includes in particular:

two lateral rails, each carrying at least the second seat for one of the primary helical springs, a chassis front cross bar, extending transversely between the lateral rails, and a chassis rear cross bar, extending transversely between the lateral rails, and wherein the chassis front cross bar is integrally attached to a first rail among the lateral rails, and the rear cross bar is articulated about a pivot connection with this first rail, with an axis parallel to a general direction in which this first rail extends, and the chassis rear cross bar is integrally attached to a second rail among the lateral rails, and the front cross bar is articulated about a pivot connection with this second rail, with an axis parallel to a general direction in which this second rail extends.

The arms of the axle structure may extend longitudinally, in a manner such that the primary helical springs are offset substantially at the same height as the axle structures, unlike the bogies of the state of the art in which the primary suspensions are usually arranged above the axle structures.

Thus, the bogie according to the invention includes helical springs, while also ensuring vertical space saving characteristics with a reduced height profile, despite the fact that the helical springs are generally considered to require more space than the resilient elastomeric members.

Advantageously, the chassis of the bogie is articulated such that it allows the bogie to overcome the track defects, or track twists, unimpeded, as described previously. In this case, the bogie according to the invention may include primary suspensions that work only in a vertical direction. Such primary suspensions have a reduced space requirement and a lower complexity level compared to the primary suspensions of a rigid chassis bogie.

A bogie according to the invention may further include one or more of the following characteristic features, taken individually or in any technically possible combinations:

Each primary helical spring extends in a direction substantially perpendicular to the general direction in which extends the rail bearing the second seat for this primary helical spring.

At least one amongst the lateral rails has a motor, this motor being connected to at least one of the wheel by means of a reduction gear.

The bogie comprises of: a load bearing cross member, designed for carrying a railway vehicle body, and secondary suspension means including, for each of the lateral rails, at least one secondary helical spring extending between a first seat, provided on this rail, and a second seat, provided on the load bearing cross member.

Each secondary helical spring extends along a direction substantially perpendicular to the general direction in which extends the rail carrying the first seat for this secondary helical spring.

Each axle structure includes an axle cross member, extending between the axle boxes of this axle structure, and bearing an axle shaft integrally attached to the wheels between which extends this axle structure.

The invention also provides a railway vehicle, in particular a low floor tram, including a bogie as defined here above.

BRIEF DESCRIPTION OF THE DRAWINGS

The invention will be better understood upon reading the description which follows, provided solely by way of example and with reference being made to the accompanying figures in which.

DETAILED DESCRIPTION

As used in the present description, the terms "vertical" and "horizontal" are defined relative to a bogie mounted in a railway vehicle. Thus, a horizontal plane is substantially parallel to the plane in which the axles extend and the vertical plane is substantially parallel to the plane in which the wheels extend.

The term "longitudinal" is defined relative to the direction in which a rail vehicle extends in a horizontal plane, and the term "transverse" is defined along a direction that is substantially perpendicular to the longitudinal direction in a horizontal plane.

A marker has been shown in the Figures, wherein the longitudinal direction is designated by the reference X, the transverse direction is designated by the reference Y, and the vertical direction, perpendicular to the longitudinal direction X and the transverse directions Y, is designated by the reference Z.

Moreover, the terms "front" and "rear" are defined relative to the direction of movement of the railway vehicle in the longitudinal direction X. By convention, in the figures, the term "front" corresponds to the left and the term "back" to the right.

Figure 1:
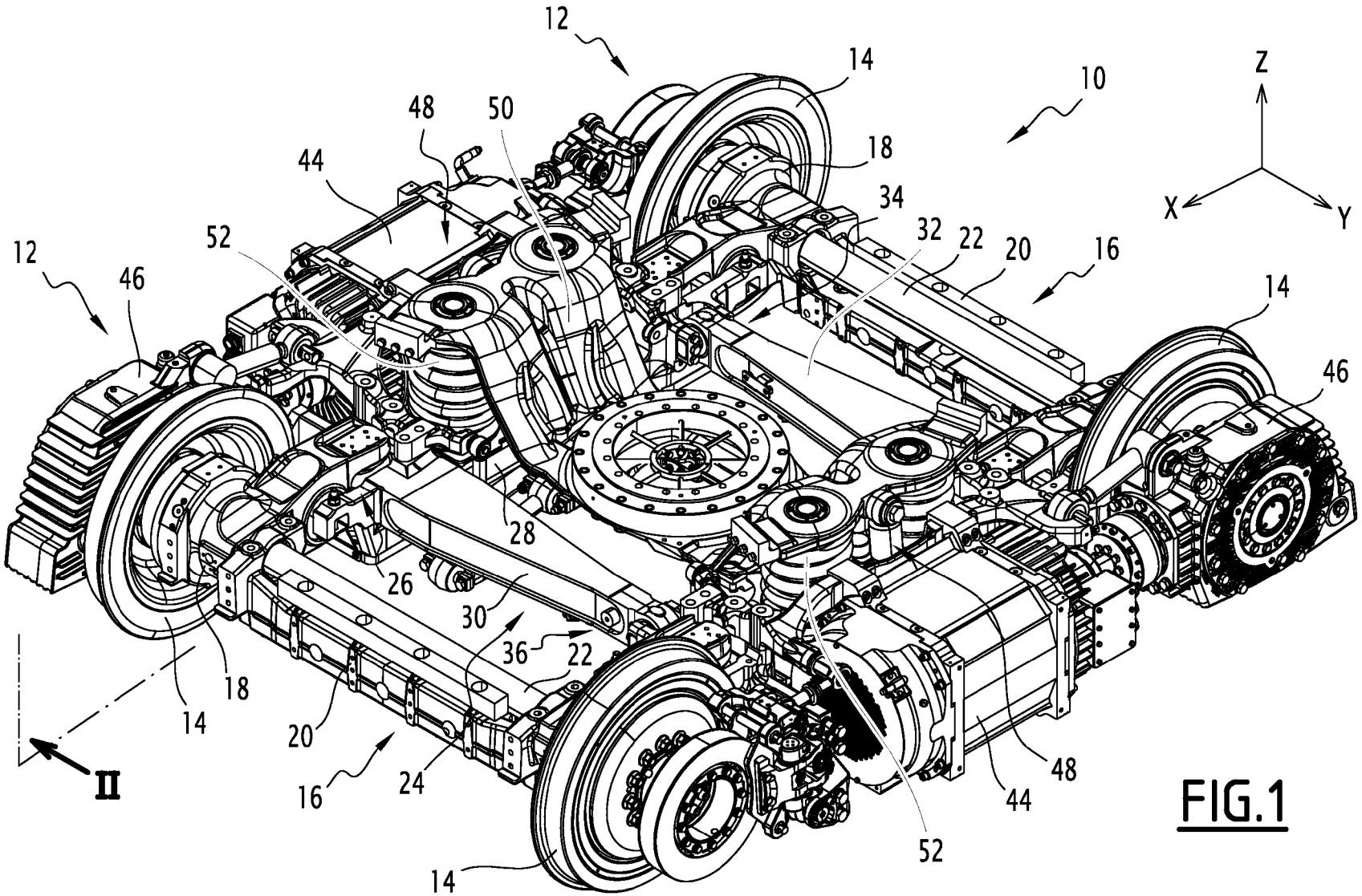
FIG. 1 is a perspective view of a railway vehicle bogie according to an exemplary embodiment of the invention.

Represented in FIG. 1 is a bogie 10 of a railway vehicle, for example, for a low-floor tram.

The bogie 10 has two pairs 12 of wheels 14, arranged respectively at the front and at the rear of the bogie 10. The wheels 14 of each pair are connected to each other by an axle structure 16.

Each axle structure 16 comprises of two axle boxes 18, that is to say, one for each wheel 14, as well as an axle cross member 20 extending transversely between the two axle boxes 18 and integrally attached to these axle boxes 18. Each axle cross member 20 carries an axle shaft 22 extending transversely between the wheels 14 and integrally attached to the wheels 14. In a conventional manner, the axle boxes 18 and the axle cross member 20 form an integral single piece assembly, resistant to bending and torsional strain around the axle shaft and the axle shaft 22 ensures transmission between the two wheels 14 of the axle.

The axle structures 16 are supported by an articulated chassis 24 through a primary suspension device, for example, the primary suspension means 26 which will be described later.

In the example shown, the chassis 24 is said to be of the interior type, that is to say, it is disposed in a space delimited by the wheels 14. Such an interior chassis presents a reduced mass, and has low manufacturing costs.

The chassis 24 includes two lateral rails 28 and two chassis cross bars, in particular a front cross bar 30 and a rear cross bar 32, each extending transversely between the lateral rails 28.

In the following sections, a first rail among the lateral rails 28 will be called right rail, and the other rail will be called left rail. Only the right rail is visible in FIG. 1.

Each cross bar 30, 32 is integrally attached to a respective lateral rail 28, and is articulated around a pivot connection with the other rail 28, with an axis parallel to a general direction in which the rail 28 with which it is articulated extends. In the absence of any track defects, the general direction of the rail 28 is substantially parallel to the longitudinal direction X.

In the example described, the front cross bar 30 is integrally attached to the right rail 28 and the rear cross bar 32 is articulated around a pivot connection 34 with this right rail. In addition, the rear cross bar 32 is integrally attached to the left rail, and the front cross bar 30 is articulated around a pivot connection 36 with this left rail.

Thus, the chassis 24 includes two L shaped parts, each L shaped part being formed by a cross member and a respective rail. These two L-shaped parts are articulated relative to each other substantially about a diagonal axis passing through the pivot connections 34, 36.

It should be noted that an articulated chassis similar to the one in the invention is, for example, described in EP 0 834 435.

As previously mentioned above, the chassis 24 is connected to the axle 16 structures by way of primary suspension means 26 which will now be described. More particularly, each lateral rail 28 is connected to an axle box 18 by way of these primary suspension means or devices 26.

Figure 2:
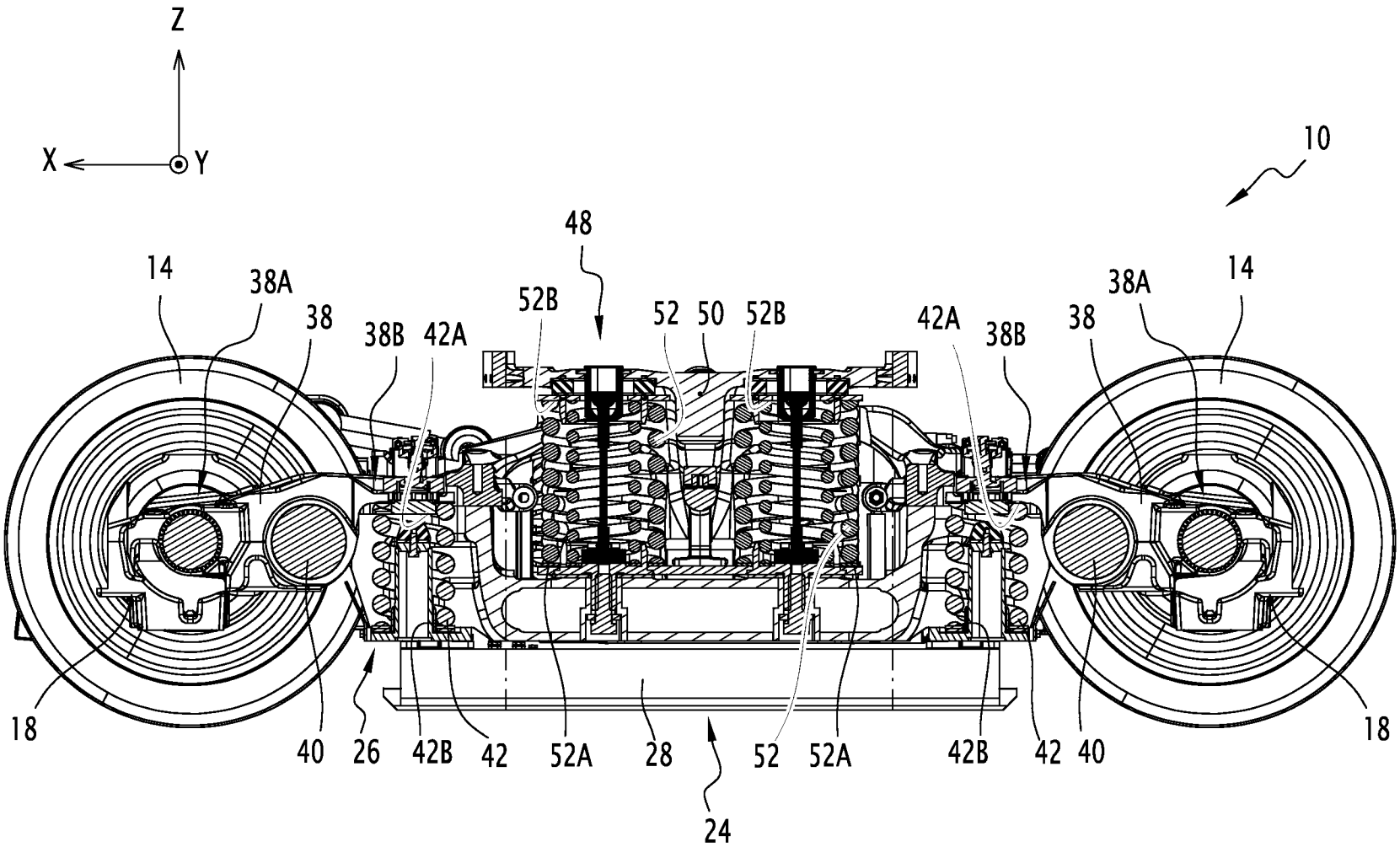
FIG. 2 is a cross sectional view of the bogie in FIG. 1, in a longitudinal plane II passing through the suspensions of the bogie.

As is in particular shown in FIG. 2, the suspension means or devices 26 comprise, for each axle box 18, an arm 38 extending substantially longitudinally between a first end 38A integrally attached to the corresponding axle box 18, and a second free end 38B. Each arm 38 is articulated about a pivot connection 40 with the chassis 24, in particular with one of the lateral rails 28.

The primary suspension means 26 further include, for each arm 38, a primary helical spring 42 extending between a first seat 42A, provided on the second end 38B of the arm 38, and a second seat 42B, carried by the chassis 24, in particular by the corresponding lateral rail 28.

As previously mentioned above, each arm 38 extends substantially longitudinally, such that each primary helical spring 42 is displaced substantially at the height of the axle structures 16. The vertical space requirements of the primary suspension means 26 are thus reduced, particularly in comparison to the conventional primary suspensions of the bogie, which are usually disposed above the axle structures.

Advantageously, each primary helical spring 42 extends along a direction substantially vertical Z, that is to say substantially perpendicular to the general direction in which extends the rail 28 carrying the second seat 42B for this primary helical spring 42. In effect, since the chassis 24 is articulated, it is the articulation of this chassis 24 around the diagonal passing through the articulation joints 34 and 36, which makes it possible to limit the wheel unloading induced by track defects, and not the axles 16 associated with the primary suspension means 26, these primary suspension means 26 thus being capable of being adapted to work only along the vertical direction Z.

Thus, the primary suspension 26 allows a relative vertical movement of the axle structure 16 relative to the chassis 24, that is to say that, the axle structure 16 is suspended relative to the chassis 24 along a direction that is substantially vertical Z, and rotationally movable about an axis passing through the pivot connections 40.

In the event that the bogie 10 is an engine bogie, at least one of the lateral rails 28 carries a motor 44. In a conventional manner, each motor 44 is connected to at least one of the wheels 14 by means of a reduction gear 46 and a clutch connecting the motor 44 to the reduction gear 46.

The bogie 10 further includes secondary suspension means or device 48, allowing relative vertical movement of the bogie 10 in relation to the railway vehicle on which said bogie 10 is mounted.

Thus, the bogie 10 includes a load bearing cross member 50 of the conventional type, intended for supporting a railway vehicle body.

The secondary suspension means 48 includes, for each of the lateral rails 28, at least one secondary helical spring 52, for example two secondary helical springs 52 arranged in parallel, each extending between a first seat 52A provided on the rail 28, and a second seat 52B provided on the load bearing cross member 50.

Advantageously, each secondary helical spring 52 extends in a substantially vertical direction Z, that is to say, in a direction substantially perpendicular to the general direction in which extends the rail 28 bearing the first seat 52A for this secondary helical spring 52.

It should be noted that the invention is not limited to the embodiment previously described here above, but may have different variants without departing from the scope of the claims.

In particular, the invention could be applied to a trailer bogie, not having a motor.

In addition, the articulated chassis of the bogie could present an articulated structure other than that which has been previously described.

Finally, the bogie according to the invention could be fitted to any other railway vehicle other than a tram, for example, a subway or a mainline train.

What is claimed is:

1. A bogie of a railway vehicle comprising:

two pairs of wheels;

axle structures connecting the wheels of each pair to each other, the axle structures including axle boxes for each wheel of the corresponding pair;

an articulated chassis supporting the axle structures, the articulated chassis including two lateral rails, a chassis front cross bar extending transversely between the two lateral rails and a chassis rear cross bar extending transversely between the lateral rails; and primary suspension devices, each axle structure being supported by the chassis by one of the primary suspension devices, the primary suspension devices including:

for each wheel, an arm extending substantially longitudinally between a first end that is integrally joined with the axle box associated with the wheel, and a second free end, the arm being articulated between the first and second ends about a pivot connection with the chassis, and for each arm, a primary helical spring extending between a first seat provided on the second end of the arm, and a second seat carried by the chassis, each lateral rail carrying at least the second seat for one of the primary helical springs, the chassis front cross bar being integrally attached to a first rail of the two lateral rails, the chassis rear cross bar being articulated about a pivot connection with the first rail, with an axis parallel to a direction in which the first rail extends, the chassis rear cross bar being integrally attached to a second rail of the two lateral rails, the front cross bar being articulated about a pivot connection with the second rail, with an axis parallel to a direction in which the second rail extends.

2. The bogie according to claim 1, wherein each primary helical spring extends in a direction substantially perpendicular to the direction in which extends the rail bearing the second seat for this primary helical spring.

3. The bogie according to claim 1, wherein at least one of the two lateral rails includes a motor, the motor being connected to at least one of the wheels by a reduction gear.

4. The bogie according to claim 1, further comprising:

a load bearing cross member, designed for carrying a railway vehicle body; and secondary suspension devices, including, for each of the two lateral rails, at least one secondary helical spring extending between a first seat, provided on the lateral rail, and a second seat, provided on the load bearing cross member.

5. The bogie according to claim 4, wherein each secondary helical spring extends along a direction substantially perpendicular to a direction in which extends the lateral rail carrying the first seat for the secondary helical spring.

6. The bogie according to claim 1, wherein each axle structure includes an axle cross member extending between the axle boxes of the axle structure and bearing an axle shaft integrally attached to the wheels between which the axle structure extends.

7. A railway vehicle including at least one bogie, the at least one bogie comprising:

two pairs of wheels;

axle structures connecting the wheels of each pair to each other, the axle structures including axle boxes for each wheel of the corresponding pair;

an articulated chassis supporting the axle structures, the articulated chassis including two lateral rails, a chassis front cross bar extending transversely between the two lateral rails and a chassis rear cross bar extending transversely between the lateral rails; and primary suspension devices, each axle structure being supported by the chassis by one of the primary suspension devices, the primary suspension devices including:

for each wheel, an arm extending substantially longitudinally between a first end that is integrally joined with the axle box associated with the wheel, and a second free end, the arm being articulated between the first and second ends about a pivot connection with the chassis, and for each arm, a primary helical spring extending between a first seat provided on the second end of the arm, and a second seat carried by the chassis, each lateral rail carrying at least the second seat for one of the primary helical springs, the chassis front cross bar being integrally attached to a first rail of the two lateral rails, the chassis rear cross bar being articulated about a pivot connection with the first rail, with an axis parallel to a direction in which the first rail extends, the chassis rear cross bar being integrally attached to a second rail of the two lateral rails, the front cross bar being articulated about a pivot connection with the second rail, with an axis parallel to a direction in which the second rail extends.

8. The bogie according to claim 1 wherein the railway vehicle is a low floor tram.

9. The railway vehicle according to claim 7 wherein the railway vehicle is a low floor tram.

* * * * *